United States Patent [19]

Carlin

[11] Patent Number: 4,651,772

[45] Date of Patent: Mar. 24, 1987

[54] FLOW RETARDING VALVE FOR FIRE HYDRANTS

[76] Inventor: Jack M. Carlin, 4948 Ladera Sarina, Del Mar, Calif. 92014

[21] Appl. No.: 887,055

[22] Filed: Jul. 18, 1986

[51] Int. Cl.[4] ..... E03B 9/02

[52] U.S. Cl. ..... 177/299; 137/467; 137/67; 137/613

[58] Field of Search ..... 137/67, 299, 467, 613

[56] References Cited

U.S. PATENT DOCUMENTS 797,384 8/1905 Thurston ..... 137/299

3,476,133 11/1969 Stedfeld ..... 137/467 X 4,114,653 9/1978 Carlin ..... 137/67 X 4,323,219 4/1982 Carlin ..... 137/467 X

*Primary Examiner*—Harold W. Weakley

*Attorney, Agent, or Firm*—Ralph Branscomb

[57] ABSTRACT

A delay valve is attached to a fire hydrant and interposed between the hydrant and the hose and restricts the otherwise high flow and high pressure of the hydrant to a small fraction of the normal flow and pressure until the hose is filled up, at which point the valve opens fully so that the hose and hydrant are fully operational.

16 Claims, 15 Drawing Figures

FLOW RETARDING VALVE FOR FIRE HYDRANTS

BACKGROUND OF THE INVENTION

The invention is in the field of fire fighting, and more particularly, pertains to delaying the full pressure and flow of water from the fire hydrant until the firemen have laid the hose and are ready to fight the fire. The inventor is also the inventor of a PRESSURE DIFFERENTIAL FLOW RETARDANT VALVE, issued Oct. 3, 1978, having U.S. Pat. No. 4,117,860.

The valve of the prior invention and the instant valve address a specific problem that occurs in fighting fires. Namely, as the fire truck with its crew approach the fire, one of the firemen must get off the truck at the hydrant with the hose, attach the hose, and wait. While he waits, the fire truck makes its way to the fire and lays out the hose. Once the truck is at the sight of the fire, the hydrant man opens the hydrant and then runs to the fire site. Valuable fire fighting time is lost for this man while he is in transit from the hydrant to the fire.

If the hydrant is opened too fast, an enormous water manner can result which can be very dangerous. Clearly, the hydrant cannot be opened until the entire length of hose that is to be used is laid. If the man by the hydrant accidentally opens the hydrant while the hose is still coming off the truck, serious problems occur.

The purpose of this invention, as was the purpose of the invention having U.S. Pat. No. 4,117,860, is to provide a valve that can be attached to the hydrant which will automatically delay the flow of water from the hydrant after it is opened so that the full crew can proceed to the fire without leaving one man behind to open the hydrant when the hose has been laid.

As with U.S. Pat. No. 4,117,860, this valve is automatic. There have been attempts to make radio-controlled valves, which, on its surface, sounds like the ideal situation inasmuch as complete control of the timing would be had at the actual site of the fire. In practicality, however, the juxtaposition of the somewhat delicate electronics needed to operate a remote controlled radio connection with the heavy, rough, wet environment of the fire hydrant have led to inadequate reliability for this approach to be feasible. Clearly, when the fire is raging out of control, it is totally unacceptable to find out two blocks away from the hydrant that the radio controlled mechanism has failed and the hydrant won't open.

SUMMARY OF THE INVENTION

The valve of the instant disclosure is somewhat different in operation than the previous valve, and is also simpler both in construction and in operation. Whereas the valve in the abovestated patent utilizes a hinged flap, which opens under spring pressure once the pressure on both sides is equalized, the valve of the instant disclosure utilizes a sliding gate valve which opens automatically upon the occurrence of substantially equal pressure on both sides, without the use of any springs or biasing mechanisms whatsoever. This is achieved by the mechanism of a valve stem which attaches to the sliding gate, and which slidably exits the internal pressure chamber of the valve so that once the unilateral pressure on the gate which forces it against the valve outlet is eased, the natural hydraulic displacement occurring within the internal pressure chamber of the valve due to the exiting valve stem will cause it to open.

The valve must permit the flow of water from the fire hydrant into the fire hose at a comparatively gradual rate shortly after the valve is attached to the hydrant. This is achieved by either of two mechanisms. According to the first, the gate of the valve remains slightly open in the initial stages of operation so that a safe flow occurs, somewhat like the valve in the above-referenced patent. According to the second implementation of the invention, an errodable disk is incorporated in the central portion of the gate. The disk initially has a small hole in the center and as the water rushes through the hole under very high pressure, the disk erodes to create faster and faster water flow. By virtue of the geometric increase in the rate of flow of water through the disk, the valve will automatically be timed to delay the approximately correct amount despite the fact that the hose length used may be a couple of blocks long, or single short length. In other words, the slow flow that would be necessary for a very short length would unduly delay the filling of a longer hose, and the erosion of the disk accommodates this situation.

DETAILED DESCRIPTION OF THE PREFERRED EMBODIMENT

Figure 1:
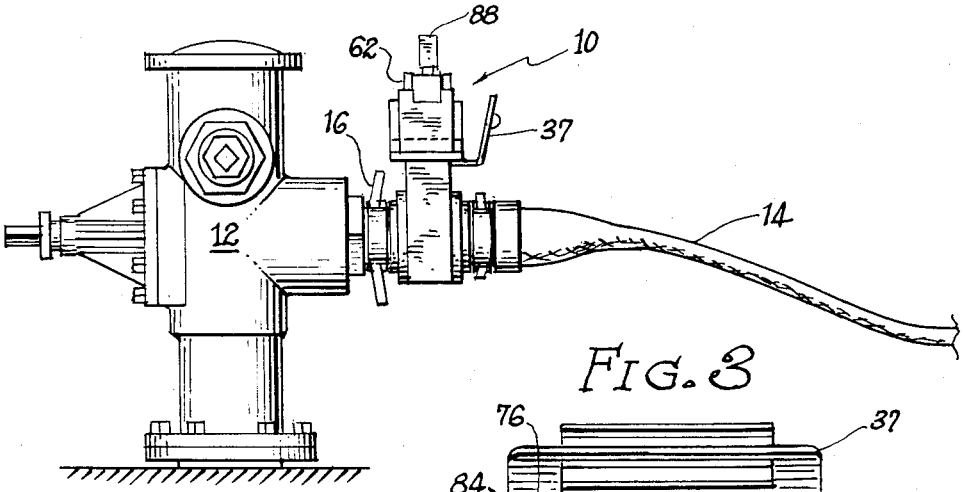
FIG. 1 illustrates a fire hydrant with the valve and fire hose attached.

The environment of the invention is shown in FIG. 1 wherein the valve 10 connects to a fire hydrant 12 and at the other end connects to a conventional fire hose 14. A conventional fire hydrant coupling 16 connects the inlet sleeve 18 of the valve to the hydrant. The inlet sleeve connects to the coupling 16 in a rotating fashion by virtue of a pair of matching channels 20 shown in FIG. 4 which are filled with rollerbearings. No. 22 in that Figure represents a rubber seal.

The outlet side of the valve similarly has an outlet sleeve 24 which is threaded into the valve and provides the threaded male member for the hose coupling. Both the inlet and outlet sleeves 18 and 24 are threaded into the main housing 28 of the valve and are sealed with "O" rings 30 to prevent water from seeping into the threaded area and causing corrosion.

Figure 2:
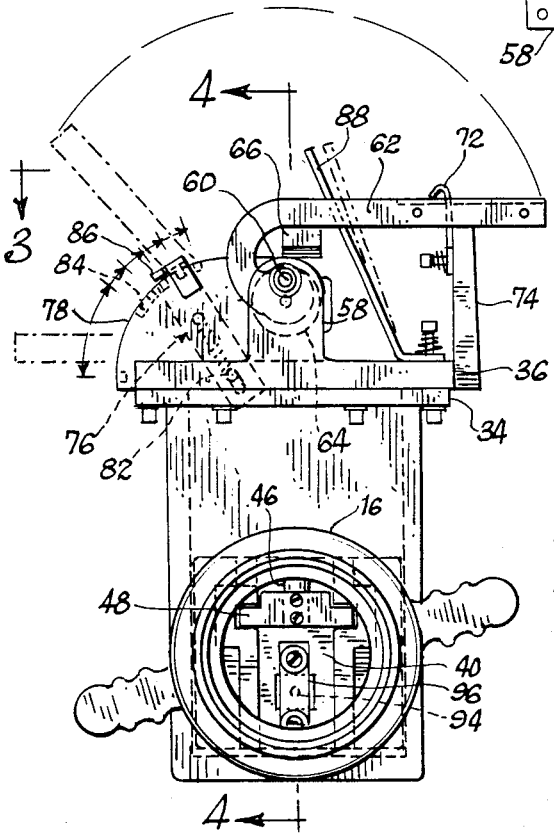
FIG. 2 is an end elevation view looking into the valve from the hydrant side.

The housing itself is basically a rectangular box with enlarged bosses 32 to accommodate the threads for the inlet and outlet sleeves. The box is substantially thinner, as shown in FIG. 4, than it is wide, as shown in FIG. 2.

The top of the housing has a continuous flange 34 through which it bolts to the housing top 36. A carrying handle 37 bolts beneath the housing flange on the one side as shown in FIG. 4. The main body of the housing 28 and the housing top 36 define a high pressure chamber 38 capable of withstanding the relatively high pressure of water from the fire hydrant. The housing body and top are of cast aluminum in the preferred embodiment, with walls at least a half inch thick. It could be made of tough plastic, brass, or any other suitably strong material, as well as from aluminum.

Figure 4:
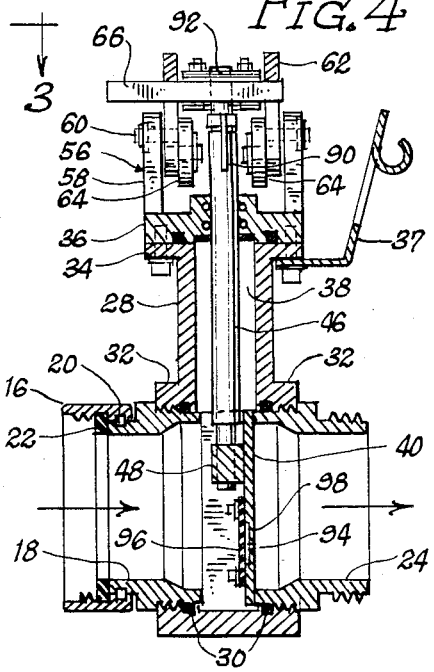
FIG. 4 is a section taken along line 4—4 of FIG. 2.

Inside, and in the generally lower portion of the pressure chamber as shown in FIG. 4, is a gate 40 which, when pressed against the outlet sleeve as shown in FIG. 4, define the closed position of the gate. The gate is generally a flat plate, but has a pair of vertical ribs 42 with a pair of opposed ears 44 which basically act as spacers. As is well illustrated in FIG. 7, the main flat portion of the gate together with the spacer ribs enable it to fit rather loosely within the pressure chamber 38.

Figure 5:
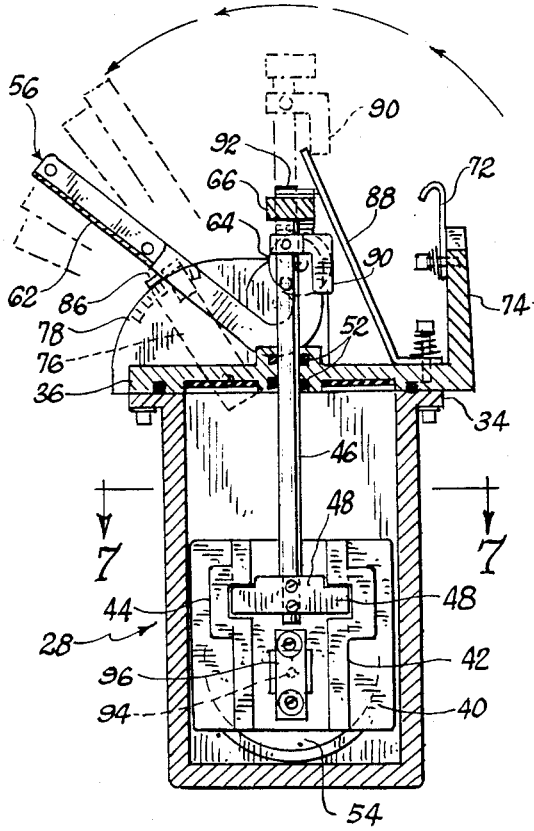
FIG. 5 is a vertical section taken substantially centrally of the valve parallel to the gate.
Figure 7:
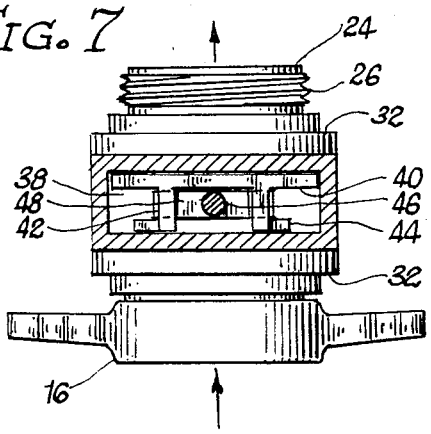
FIG. 7 is a section taken along line 7—7 of FIG. 5.
Figure 8:
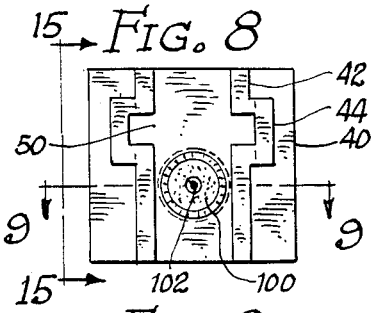
FIG. 8 is a front elevation view of a modification of the valve in which the erodable disk is mounted in the valve gate.
Figure 9:
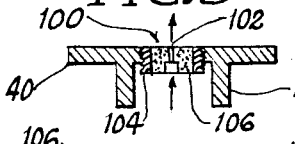
FIG. 9 is a section taken along line 9—9 of FIG. 8.

The gate is connected to a main stem 46 by means of a "T"-bar 48 which engages in the expanded space 50 defined by the ears 44 in the ribs. This structure is best shown in FIG. 5. The T-bar is captured between the ears by the sidewalls of the housing as shown in FIGS. 4 and 7. The engagement of the T-bar with the gate is again very loose, inasmuch as the importance of preventing binding or jamming is greater than achieving precise fitting.

The stem extends up through a hole in the housing top 36 where a pair of O-rings 52 seal between the stem and the surrounding structure.

The structure as thus far described is sufficient to understand the basic operation of the valve. When initially set and in place on a fire hydrant, there must be some passageway provided for the water to bypass the blocking action of the gate and flow with a much reduced rate into the fire hose. As shown in FIG. 5, one way of achieving this is to set the gate slightly above the bottom of the outlet to provide a crescent-shaped opening 54 through the valve. When the valve is in place and the hydrant is first turned on, there is an enormous pressure against the upstream side of the valve holding it very firmly against the mouth of the outlet sleeve. The pressure on the downstream side of the gate would be atmospheric, and of course increasing somewhat as the hose is filled, with a rapid increase toward the end of the filling process.

Once the hose is filled, the pressure equalizes on both sides of the gate, with the effect that the force against the upstream side of the gate previously holding it frictionally firmly against the outlet is equalized, and there is no longer pressure on the gate against the outlet. At this point, the high pressure of the water inside the pressure chamber 38 will displace the gate upwardly, because the top end of the stem 46 extends out of the pressure chamber into atmospheric pressure. In other words, although the high water pressure within the pressure chamber was extant virtually from the time the fire hydrant was first turned on, the frictional engagement of the gate against the outlet more than overcomes the displacement force which tries to move the valve gate and its stem upwardly, until the hose is filled.

This simple mechanism thus works with no springs or biasing means whatsoever. It is of course necessary to hold the gate in its initial position, which could be done gravitationally if desired, but which is done by means of the gate positioning mechanism 56 in the first embodiment. This mechanism is primarily mounted to a pair of upstanding arms 58 which are part of the cast housing top 36. These arms provide the main journals 60 for the mounting of the double-sided clamp arm 62, which in turn journals camming rollers 64.

Figure 3:
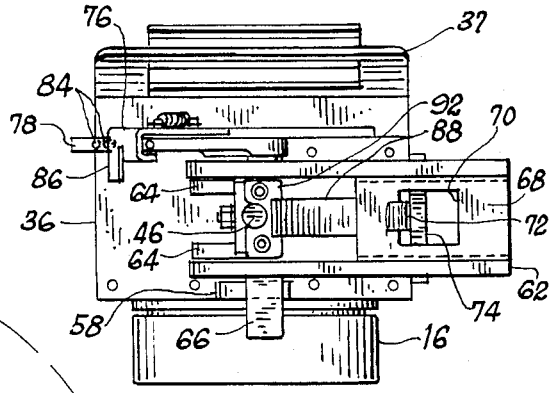
FIG. 3 is a top plan view of the valve as indicated in FIG. 2.

The clamp arm and its camming rollers act on a cross-bar 66 mounted laterally across the top of the stem. Looking at FIG. 2, when the clamp is swung into the right position as shown in solid line, the inside of the double-sided arm forces the top of the cross-bar down, moving the stem down and consequently the gate into the lowermost, completely closed position shown in FIG. 4. The clamp arm has a plate structure 68 between its two sides as best shown in FIG. 3, and through the hole 70 of this plate passes a resilient clip 72, which will hold the gate in down position until released. The clip 72 is mounted on a wall 74 which is cast with the rest of the top of the housing.

In operation, once the gate is in the position shown in FIG. 4, the hydrant valve is turned on, causing a tremendous pressure on the left side of the gate as shown in FIG. 4. At this point, no water whatsoever will pass through the valve. In order to crack the valve slightly, the clamp arm 62 is released and swung to the left as indicated in FIG. 2, with the result that the camming rollers 64 roll against the underside of the crossbar 66, forcing it up slightly. The amount that the gate is forced up depends on the setting of the adjustable stop 76, which mounts on an arc portion 78 of the top casting 36. As is best seen in FIG. 6, the adjustable stop comprises a swing-arm 80 spring loaded radially inwardly about its pivot 82 to engage in various ones of the bores 84, there being an arm 86, best seen in FIG. 3, which extends to define the stop limit of the adjustable stop.

Once the clamp arm is swung into the left position as indicated in FIG. 2, it releases the stem to slide upwardly, and only the force of the water on the gate, pressing it against the outlet, keeps it from being pushed up by the hydraulic displacement pressure within the pressure chamber of the valve. When the hose fills and the pressure on either side of the gate equalizes, the valve opens, unhindered by the clamp arm 62.

Figure 6:
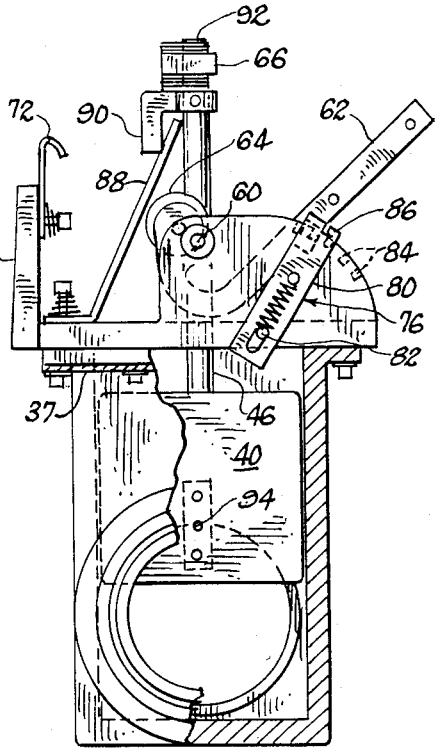
FIG. 6 is a side elevation view of the valve with portions cut away.

Once the valve has opened completely, a catch 88 snaps under a flange 90 as shown in FIGS. 5 and 6 to prevent the gate from sliding down anymore until the catch is manually released. The catch is a resilient strip of metal that is biased against the stem.

Other features of the first embodiment of the invention include a series of shims 92, which are stored on the top of the cross-bar until moved as needed to the bottom of the crossbar to define the desired size of the opening 54 to accommodate different fire companies. Also, as is seen in FIGS. 4 and 5, a small pin hole 94 through the gate defines an air bleed so that air trapped in the hydrant system can escape into the hose after the valve is mounted on the hydrant to rapidly bring the water up to the position of the gate. A rubber flap or the equivalent 96 is bolted over the pin hole on the upstream side, so that when the water reaches the flap, it will cose it against the pin hole. The flap is spaced slightly from the pin hole by virtue of a recess 98 in the gate valve to permit the escape of air.

Figure 10:
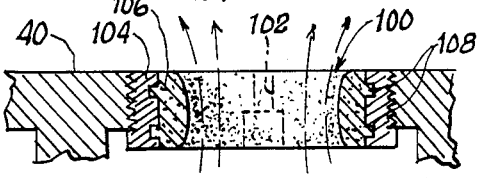
FIG. 10 is an enlarged fragmentary section taken through the disk and its surrounding structure after it is marginally eroded.

The above discussion pertains to an embodiment of the valve in which the valve bypass is achieved by raising the gate slightly to create a passageway 54. In an alternative second embodiment, there is no need to raise the gate, and thus the roller cam structure, the shims, and the adjustable stop 76 would not be needed. According to the second embodiment, rather than raising the gate, a passageway is provided by the utilization of a removable, erodable disk 100 which has a small hole 102 in the center so that as the water rushes through, the hole becomes larger and larger until it approximates the configuration shown in FIG. 10. The hole is of two different diameters in the illustration so that the smallest portion of the hole is thinwalled and erodes quickly, to get the erosion process started smoothly and without incident.

In the embodiment illustrated, the disk comprises a metal rim 104 which threadedly engages in a hole in the gate, and the interior of the disk constitutes an erodable material 106 such as an adulterated mixture of plaster of Paris. Grooves 108 defined on the internal surface of the rim 104 grip the erodable center, which is cast into place.

Of course, after every use, the old, eroded disk must be removed and a new one inserted in its place. However, this can be done at leisure at the fire house, and serves to reduce the level of complexity of the action at the fire site by eliminating the need to raise the gate after the hydrant is turned on.

When the erodable disk embodiment is used, the gate positioning mechanism 56 is largely unneccessary because it is not necessary to raise the gate slightly against the enormous pressure from the fire hydrant on the upstream side. Therefore, a much simplified mechanism can be used as is illustrated in FIG. 11-14. Rather than utilizing the housing top 36 with the gate mechanism 56, a header 110 can be used, which again could be cast aluminum or one of the other materials enumerated above. This head is preferably cast to include a pair of bosses 112 substantially at one end, and a three-sided seat structure 114 at the other. Also, a handle 116 should be included in the casting of the head to facilitate handling the valve. An O-ring 11 mounts in a groove in the head, and the head is bolted to the housing 28 of the valve as was the housing top 36 of the previous embodiments. The structure below the head remains the same.

Figure 11:
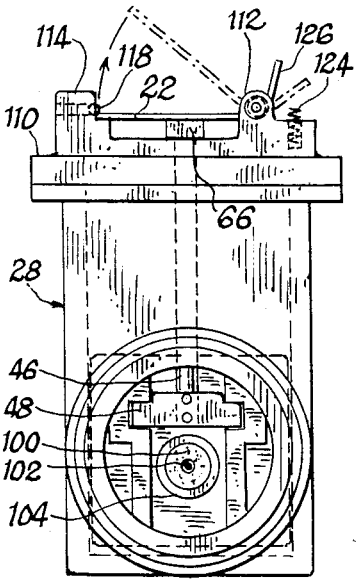
FIG. 11 is an elevation view looking at the inlet side of a modified form of the erodable disc embodiments.
Figure 12:
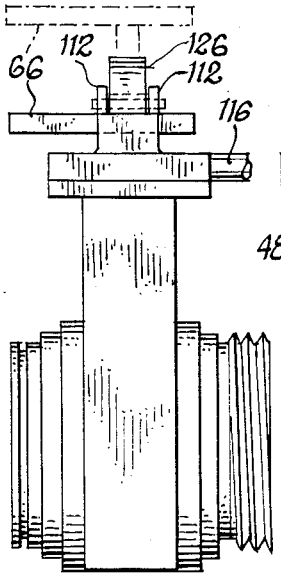
FIG. 12 is a side elevation view of the invention looking from the right side of FIG. 11.
Figure 13:
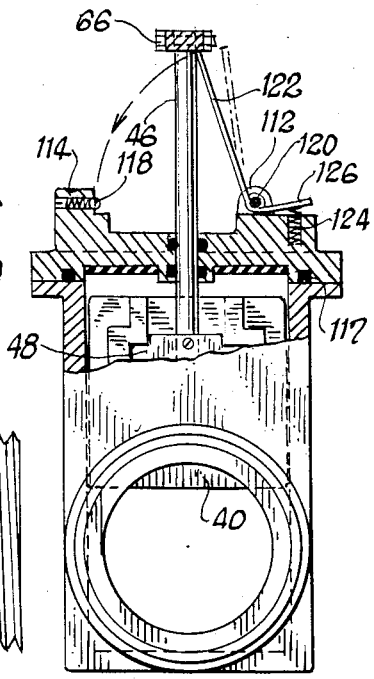
FIG. 13 is a view similar to FIG. 11 but with the gate raised.
Figure 14:
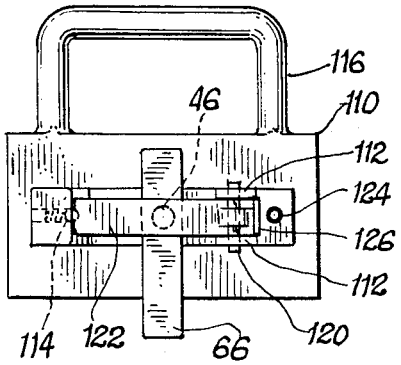
FIG. 14 is a top plan view.
Figure 15:
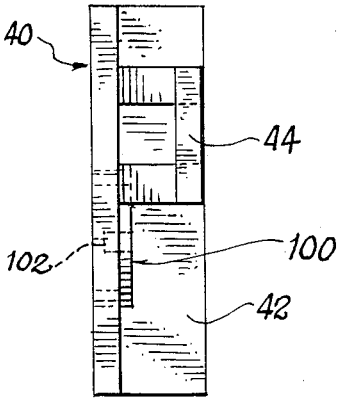
FIG. 15 is a view along line 15—15 of FIG. 8.

The seat 114 has a spring-loaded detent 118 mounted in it as shown in FIGS. 11 and 13. The two bosses 112 mount a small shaft 120 on which is journalled a generally L-shaped sheet metal rocker arm catch 122, which is journalled at the crook. On the side the journal opposite the stem 46 is a spring 124, housed in a bore either cast or actually bored into the top of a head.

The action of the valve is fairly simple, and is illustrated in FIGS. 11 and 13. Once the gate is in its lowered position as shown in FIG. 11, it will stay there of its own accord, unless the valve is turned upside down or violently jostled. To make sure that it remains down however, the catch 22 engages beneath the detent 118 in the seat 114 as shown in FIG. 11, so that the catch holds the cross bar T down against the gate in its lowered position as shown in FIG. 11.

The strength of engagement of the catch by the detent 118 is low, so that when the valve fills, the internal hydraulic pressure in the internal chamber of the valve will cause the gate to rise, forcing the stem upwardly and out of the internal pressure chamber as shown in FIG. 13. As the stem rises, it pushes the lever into its full-back position, shown in dotted line in FIG. 13, and once the cross-bar 66 rises into its ultimate position, the catch snaps back as shown in full line in FIG. 13 under action of the spring 124. Once the catch is captured beneath the cross bar 66, the gate will remain in this position until the cross bar is raised slightly, and the right end 126 of the catch pressed down against the spring tension to move the catch back in the position illustrated in the dotted line in FIG. 13. The crossbar 66 could be replaced with some other, smaller element, but some member extending beyond the stem, or at least a notch in the stem, is necessary to engage the end of the catch.

The embodiment illustrated in FIGS. 11 through 14 is reduced to the simplest, most basic form. This is made possible by ulitization of the erodable disc 100, because otherwise some forcing mechanism is required to raise the gate slightly to make a restricted flow passageway once the upstream hydrant pressure begins.

All of the embodiments provide an improved, simplified, and more foolproof means of fighting fires than is currently available. The mechanisms are simple, durable, and virtually foolproof, and provide a needed advance in the state of the art.

I claim:

1. A delay valve for connection between a fire hydrant and a fire hose comprising:

(a) a housing defining an internal pressure chamber having an inlet for attachment to a fire hydrant and an outlet for attachment to a fire hose;

(b) a gate which slides within said housing from a closed position substantially covering said outlet to an open position substantially clear of said outlet, said gate being mounted on a stem which slidably exits said pressure chamber and which exits said pressure chamber farther as said gate moves from said closed to said open position; and (c) a gate bypass passageway permitting water from the fire hydrant to pass to the fire hose when said gate is in a substantially closed position, whereby when said valve is attached between said fire hydrant and fire hose, water pressure on the upstream side of said gate forces same into frictional engagement with said outlet while water passes through said passageway to gradually fill said hose, and once said hose is filled, the equalized hydraulic pressure within said pressure chamber forces said gate and stem to move from the closed to the open position as the stem is displaced farther out of said pressure chamber.

2. Structure according to claim 1 and including releasable clamping means for temporarily clamping said gate in a substantially closed position until the fire hydrant is turned on.

3. Structure according to claim 2 wherein said stem exits the top of said housing, and said clamping means is journaled to the top of said housing and swings over the top of said stem to block the upward movement of said stem.

4. Structure according to claim 3 and including a catch which engages said stem when said gate is in a substantially open position to maintain the gate in the open position.

5. Structure according to claim 1 wherein said gate has a pin hole therethrough with a resilient flap mounted in spaced relation to the upstream side thereof so that air trapped within the fire hydrant system can escape through the pin hole before the hose is attached.

6. Structure according to claim 1 wherein said gate in its substantially closed position does not fully cover said outlet, and leaves a space defining said passageway.

7. Structure according to claim 1 wherein said passageway is defined in erodable material and becomes progressively open as water rushes therethrough.

8. Structure according to claim 7 wherein said passageway is defined through said gate and comprises an erodable portion of said gate with a hole through the erodable portion which is relatively small prior to the erosion of the erodable material.

9. Structure according to claim 8 wherein said erodable portion is a disk inserted in said gate.

10. Structure according to claim 9 wherein said disk is replaceable.

11. Structure according to claim 10 wherein said disk is threaded and removably squeezed into a threaded bore in said disk.

12. Structure according to claim 11 wherein said disk comprises an erodable center with a non-erodable threaded coupling.

13. Structure according to claim 12 wherein said erodable center comprises adulterated plaster of Paris.

14. Structure according to claim 1 and including releasable clamping means for temporarily clamping said gate in a substantially closed position, said clamping means comprising a catch arm which swings into a down position over the exposed end of said stem and holds same in said closed position, and including a detent for holding said arm in the down position.

15. Structure according to claim 14 and including an extending member at the top of said stem which extends out beyond the diameter of said stem, and said arm is pivoted to the top of said housing and biased against said stem and of length such that said arm snaps under said extending member when the stem is in is full open position.

16. Structure according to claim 15 wherein said arm is a rocker arm having a crook pivoted to the top of said housing, and one end of said rocker arm extends away from said stem and presses against a spring imbedded in the top of said housing to bias said arm against said stem.

* * * * *